219-121

6/2/87 XR 4,670,734 SR

United States Patent [19]

Caddock

[11] Patent Number: 4,670,734

[45] Date of Patent: Jun. 2, 1987

[54] METHOD OF MAKING A COMPACT, HIGH-VOLTAGE, NONINDUCTIVE, FILM-TYPE RESISTOR

[76] Inventor: Richard E. Caddock, 1793 Chicago Ave., Riverside, Calif. 92507

[21] Appl. No.: 671,333

[22] Filed: Nov. 14, 1984

[51] Int. Cl.[4] ..... H01C 3/02

[52] U.S. Cl. ..... 338/61; 338/195; 338/293; 338/307; 219/121 LJ; 29/610 R

[58] Field of Search ..... 338/61, 195, 293, 307, 338/306, 308, 309; 219/121 LH, 121 LJ, 121 LN; 29/610 R

[56] References Cited

U.S. PATENT DOCUMENTS

| | | | |
|---|---|---|---|
| 1,068,907 | 7/1913 | Kraeuter et al. | 338/293 |
| 1,318,030 | 10/1919 | Thomson | 338/294 |
| 1,321,682 | 11/1919 | Thomson | 338/294 |
| 1,975,410 | 10/1934 | Simpson | 13/20 |
| 2,056,928 | 10/1936 | Magdziarz | 201/75 |
| 2,680,184 | 6/1954 | Cox | 219/19 |
| 2,736,852 | 2/1956 | Du Bois | 338/58 |
| 2,838,427 | 6/1958 | Pugh, Jr. | 117/212 |
| 3,074,042 | 1/1963 | McNeir et al. | 338/61 |
| 3,289,139 | 11/1966 | Hyde | 338/218 |
| 3,293,587 | 12/1966 | Robinson | 338/300 |
| 3,388,461 | 6/1968 | Lins | 29/610 |
| 3,486,221 | 12/1969 | Robinson | 29/620 |
| 3,530,573 | 9/1970 | Helgeland | 29/620 |
| 3,534,472 | 10/1970 | De Jong et al. | 29/620 |
| 3,539,309 | 11/1970 | Helgeland | 29/593 |
| 3,675,317 | 7/1972 | Martin et al. | 29/620 |
| 3,683,213 | 8/1972 | Staudte | 219/121 LJ |
| 3,699,649 | 10/1972 | McWilliams | 29/610 |
| 3,758,745 | 9/1973 | Wilker et al. | 219/121 |
| 3,786,224 | 1/1974 | Heywang et al. | 219/121 |
| 3,845,443 | 10/1974 | Fisher | 338/25 |
| 3,858,147 | 12/1974 | Caddock | 338/62 |
| 3,880,609 | 4/1975 | Caddock | 29/620 |
| 3,881,162 | 4/1975 | Caddock | 338/61 |
| 4,072,921 | 2/1978 | Sacchetti | 338/61 |
| 4,132,971 | 1/1979 | Caddock, Jr. | 338/61 |
| 4,159,459 | 6/1979 | Sease et al. | 338/61 |

FOREIGN PATENT DOCUMENTS

| | | |
|---|---|---|
| 3021288 | 12/1981 | Fed. Rep. of Germany . |
| 8005181 | 9/1981 | France . |
| 1314388 | 4/1973 | United Kingdom . |

OTHER PUBLICATIONS

Leonhard Groth, "23rd Electronic Components Conference", May 14-16, 1973, pp. 38-44.

*Primary Examiner*—E. A. Goldberg
*Assistant Examiner*—M. M. Lateef
*Attorney, Agent, or Firm*—Gausewitz, Carr & Rothenberg

[57] ABSTRACT

A method of making a high-voltage, noninductive, film-type resistor by providing on an insulating substrate a coating of resistive material. A laser beam is then operated to cut through the coating and remove portions so shaped that the remaining coating portions form a zig-zag line. The laser cutting is so effected that each zig converges toward the adjacent zag at an angle sufficiently small that there is a major inductance-cancellation effect. Stated more definitely, the laser cutting is done by making an elongated laser cut through the coating to thus expose a portion of substrate beneath the cut, then making another laser cut substantially parallel to the first-mentioned cut and having a length substantially different from that of the first-mentioned cut, thus exposing a portion of substrate beneath such other cut, and then repeating the cutting steps but with cut lengths and positions progressively different in such manner that during the repetitions the laser-beam creates a zig-zag line of resistive material.

11 Claims, 3 Drawing Figures

METHOD OF MAKING A COMPACT, HIGH-VOLTAGE, NONINDUCTIVE, FILM-TYPE RESISTOR

BACKGROUND OF THE INVENTION

Noninductive film-type resistors made by the silk screening of thick-film resistive material onto substrates are known in the art. For example, U.S. Pat. No. 3,858,147 teaches a serpentine pattern of film material silk screened onto a cylindrical substrate. As another example, reference is made to British Pat. No. 1,314,388, which teaches the silk screening of resistive material in a zigzag pattern onto a cylindrical substrate.

It is also known in the art to form serpentine resistors by the laser cutting of grooves in resistive material deposited by silk screening. This is often done, for example, relative to thick-film flat resistors, the films on which are fused before the laser cutting. U.S. Pat. No. 4,159,459 teaches a thin-film cylindrical resistor that is laser cut into a serpentine noninductive pattern.

In the laser cutting of resistive films on substrates, it is common practice to make two or more parallel and adjacent cuts in order to create a region where the removed resistive material, that is to say the gap between the remaining material, is wider than would be the case if there were only a single cut. Insofar as applicant is aware, such parallel cuts are of the same length.

High-voltage, noninductive, film-type resistors, both flat and cylindrical, are also well known in the art. However, such resistors are relatively large because of the necessity of maintaining gap widths adequate to prevent voltage breakdown, that is to say, bridging or short-circuiting of the gaps between adjacent undulations.

SUMMARY OF THE INVENTION

In accordance with the present invention, a flat or cylindrical (or other) substrate is provided with a resistive film coating. Thereafter, a laser beam is employed to remove such portions of the resistive coating as to cause the remaining, unremoved portions to have a noninductive pattern that is zigzag, as distinguished from serpentine or other. The resulting film-type resistor is then employed in high-voltage applications. The widths of the gaps between adjacent apexes of the zigzag pattern are sufficiently large that there will be no voltage breakdown or arcing between such apexes or between any other portions of the pattern.

Because of the described method and the pattern configuration, the resulting high-voltage resistor can be and is much more compact than is a conventional noninductive film-type resistor having the same voltage capability. Furthermore, and very importantly, the amount of laser time required to manufacture each high-voltage resistor is small in comparison to what would be the case if the laser-cut pattern were serpentine instead of zigzag.

In accordance with the preferred embodiments, the pattern is generated by making parallel laser cuts in stepped relationship to each other. The adjacent cuts are progressively longer and longer and/or shorter and shorter. There are, therefore, stepped side portions of the resistive line. The regions between adjacent zigs and zags are generally triangular, there being either isosceles or right (or other) triangles, as shown in the drawings.

The resulting zigzag line of resistive film can be, and preferably is, substantially less wide than is practical when only silk screening is employed.

The line width has a preferred range of from about one-half of the gap to about the full width of the gap, the "gap" being the spacing between adjacent apex regions of the zigzag line. The maximum compactness of the resistor is achieved when line width is one-half gap width.

DEFINITIONS

In the present patent application, the word "serpentine" is used not in its broader sense but instead narrowly, to denote resistive film patterns wherein adjacent lengths (arms) of the resistive line are parallel to each other except at the apexes.

The word "zigzag" is used to denote angular, not parallel, relationships between adjacent lengths (arms called zigs and zags) of the resistive line.

The word "line" denotes the strip of resistive film through which the current flows.

As previously indicated, the word "gap" denotes the spacing between adjacent apexes of the zigzag line.

DETAILED DESCRIPTION OF THE METHOD AND RESISTOR

The present film-type resistor may be (as indicated above) flat, cylindrical, etc. For purposes of simplicity of illustration, the present resistors are shown flat. Whether flat or cylindrical or other (such as ellipsoidal), each resistor has end terminations, encapsulation means, etc. As typical examples of end terminations and encapsulation, reference is made to elements 23, 24, 26, 27, and 28 of U.S. Pat. No. 3,858,147, which patent is hereby incorporated by reference herein as though set forth in full. Such patent relates to a cylindrical resistor, but the same terminations and encapsulation could be employed for flat resistors, except that the termination films 23 and 24 (FIG. 8 of U.S. Pat. No. 3,858,147) and end caps 26 (FIG. 9 thereof) are flat instead of cylindrical. Any suitable termination and encapsulation means known in the art may be employed.

Figure 2:
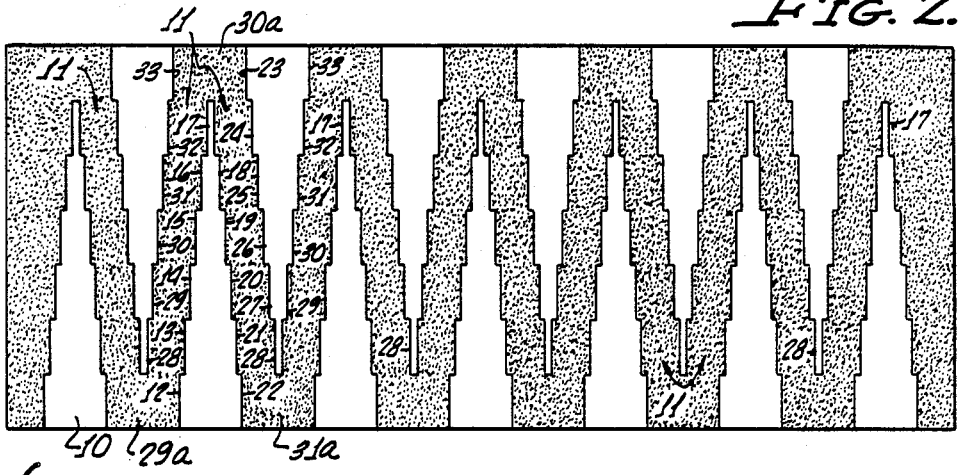
FIG. 2 is a top plan view, much less greatly enlarged, of the resistive film pattern resulting from the laser cutting illustrated in FIG. 1.
Figure 1:
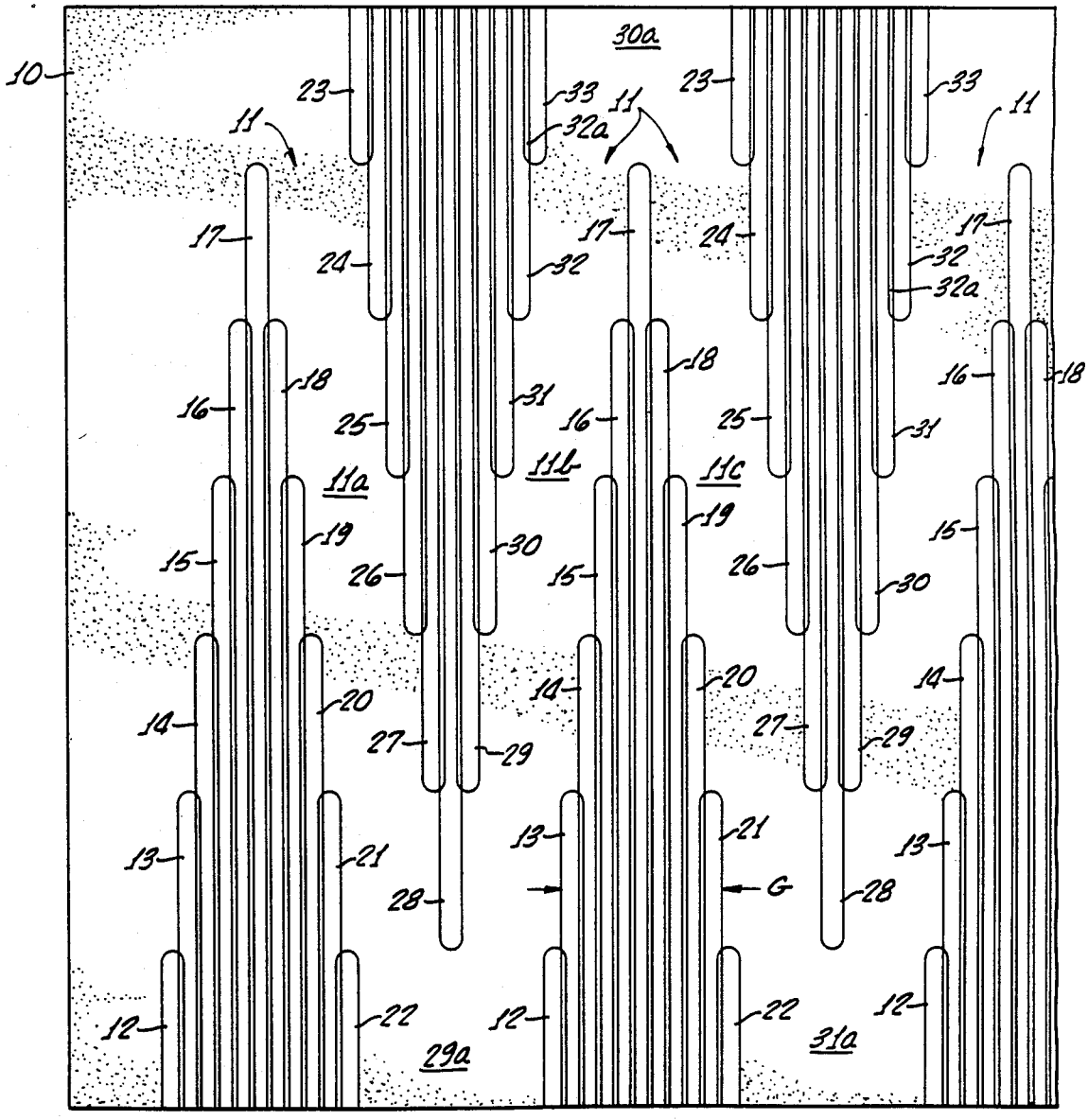
FIG. 1 is a very greatly enlarged top plan view illustrating the laser cutting that is employed in the present invention, the resistive film and laser cuts being shown relative to a flat substrate.

Referring first to FIGS. 1 and 2, the latter showing the same resistor as the former but in less greatly-enlarged form, the first steps in the method are to provide a substrate 10 of desired size and shape and to coat such substrate with a film of resistive material. The illustrated substrate 10 is rectangular, and is formed of electrically insulating material. Preferably, such insulating material is a suitable heat-resistant ceramic, such as aluminum oxide. The resistive material is a thick film and is preferably provided on the substrate 10 by silk screening. The film is applied to one side of the substrate 10, as by the apparatus and method described in U.S. Pat. No. 3,880,609, the disclosure of which is incorporated by reference herein as though set forth in full. After such application, the film, which is preferably a complex oxide resistive material consisting of electrically conductive complex metal oxides in a glass matrix, is fired and fused as stated in said U.S. Pat. No. 3,880,609.

As the next step in the method, the coated substrate is placed in a suitable laser apparatus. A laser is indicated schematically in U.S. Pat. No. 3,388,461, the disclosure of which is hereby incorporated by reference herein as though set forth in full.

As the next step in the method, the laser is employed to remove from the coated substrate all of the coating except that present along a zigzag line of resistive film. Such line is indicated generally by the number 11.

Line 11 is formed by removing, from between adjacent zigs and zags of the zigzag line, progressively longer and longer—and then shorter and shorter—strips or paths of cut regions created by vaporization of the fused resistive film where struck by the laser beam. Referring, for example, to the lower-left portion of FIG. 1, a first laser cut is shown at 12 and is relatively short. The next laser cut, numbered 13, is much longer, and subsequent laser cuts 14, 15, 16, and 17 are all progressively longer. Thereafter, progressively shorter and shorter laser cuts 18, 19, 20, 21, and 22 are made. Each such cut extends to the lower edge of substrate 10.

The result is a stepped isosceles triangle or pyramid of laser-removed resistive material, it being understood that the resistive material is entirely removed by the laser so that, as shown in FIG. 2, the substrate 10 is exposed just as if the resistive film had never been applied or fired. Each triangle or pyramid is relatively wide at the base, that is to say at the lower edge of the substrate, and tapers or converges (in stepped manner, along the equal sides of the isosceles triangle) away from such base toward the upper edge until the narrowest point, in this case the inner end of laser cut 17, is reached.

Preferably, except in the right-triangle embodiment described subsequently, the triangle is symmetrical about its central axis, namely the axis of laser cut 17. Thus, the outermost laser cuts 12 and 22 have the same lengths, as do the next cuts 13 and 21, the next 14 and 20, etc.

Additional laser cuts are then made to form an inverted triangle having its base at the upper edge of the substrate 10. Thus, for example, the next laser cut 23 is generally opposite cut 22 but extends from the upper edge of substrate 10 instead of the lower edge thereof. Progressively longer and longer laser cuts are then made from such upper edge to form the cut regions 24 through 28, following which progressively shorter laser cuts are made from such upper edge to form the cut regions 29–33. (It is emphasized that the direction of movement of the laser beam is not a factor; the stated directions of cutting are stated merely for purposed of description and illustration.)

Preferably, the triangle or pyramid formed by laser cuts 23–33 is identical to that formed by laser cuts 12–22, except that it extends from the opposite edge and in the opposite direction.

Additional laser cuts are made at other portions of the substrate to create as many zigs and zags of line 11 as desired. Such additional laser cuts correspond, respectively, to cuts 12–22 and to cuts 23–33, being therefore so numbered.

The described triangles or pyramids of laser-cut regions are interleaved, as shown, to define zigs and zags 11*a*, 11*b*, 11*c*, etc. The zigs and zags of line 11 meet at apex regions 29*a*, 30*a*, 31*a*, etc. Such apexes are between the longest cuts 17, 28, etc., and the opposed edges of substrate 10.

Let it be assumed, for purposes of illustration, that the left end of the resistor shown in FIGS. 1 and 2 is, at any particular instant, the high-voltage end. There will then, starting at the upper-left portion of FIG. 1, be a progressive and substantially linear voltage drop downwardly along zig 11*a* to apex 29*a*, thence upwardly along zag 11*b* to apex 30*a*, thence downwardly along zig 11*c* to apex 31*a*, etc. Thus, the maximum voltage drop will, in each instance, be between adjacent apexes (29*a* and 31*a*, for example) of zigzag line 11. There is, between each two adjacent apexes, the above-defined gap, which gap is indicated at "G" in FIG. 1.

The spacing between zig 11*a* and zag 11*b* decreased progressively, in stepped relationship, as apex 29*a* (for example) is approached. Thus, as an illustration, the inner ends of laser cuts 26 and 30 combine with the laser cuts therebetween to create a space which is much less than gap G. However, this is not harmful because the voltage drop or tension between those line regions adjacent the inner ends of cuts 26 and 30 is greatly less that is the voltage drop across gap G.

Thus, no more space is provided, between the zigs and zags, than is necessary to assure that there will be no breakdown at any point along the line 11, despite the high voltage applied to the resistor as stated subsequently. This is to be contrasted with a serpentine resistor, which has parallel line sections separated by a space of uniform width. Such a serpentine resistor must, for a given applied voltage, have a much greater length than does the present zigzag resistor, so that the present resistor is much more compact than is a serpentine resistor.

The present compact resistor has a highly desirable low-inductance characteristic. This is because the angle between each zig and the adjacent zag is sufficiently small that the current flowing in opposite directions therethrough will effectively cancel inductance.

Very importantly, the present invention greatly reduces the amount of laser time, which is an important factor in production cost since laser apparatuses are extremely expensive. If, for example, the pattern were serpentine instead of zigzag, each laser cut 12–16 and 18–22 (for example) would have to be as long as is the illustrated center cut 17. Instead, the outer cuts 12 and 22, for example, are only a small fraction of the length of such center cut 17.

Figure 3:
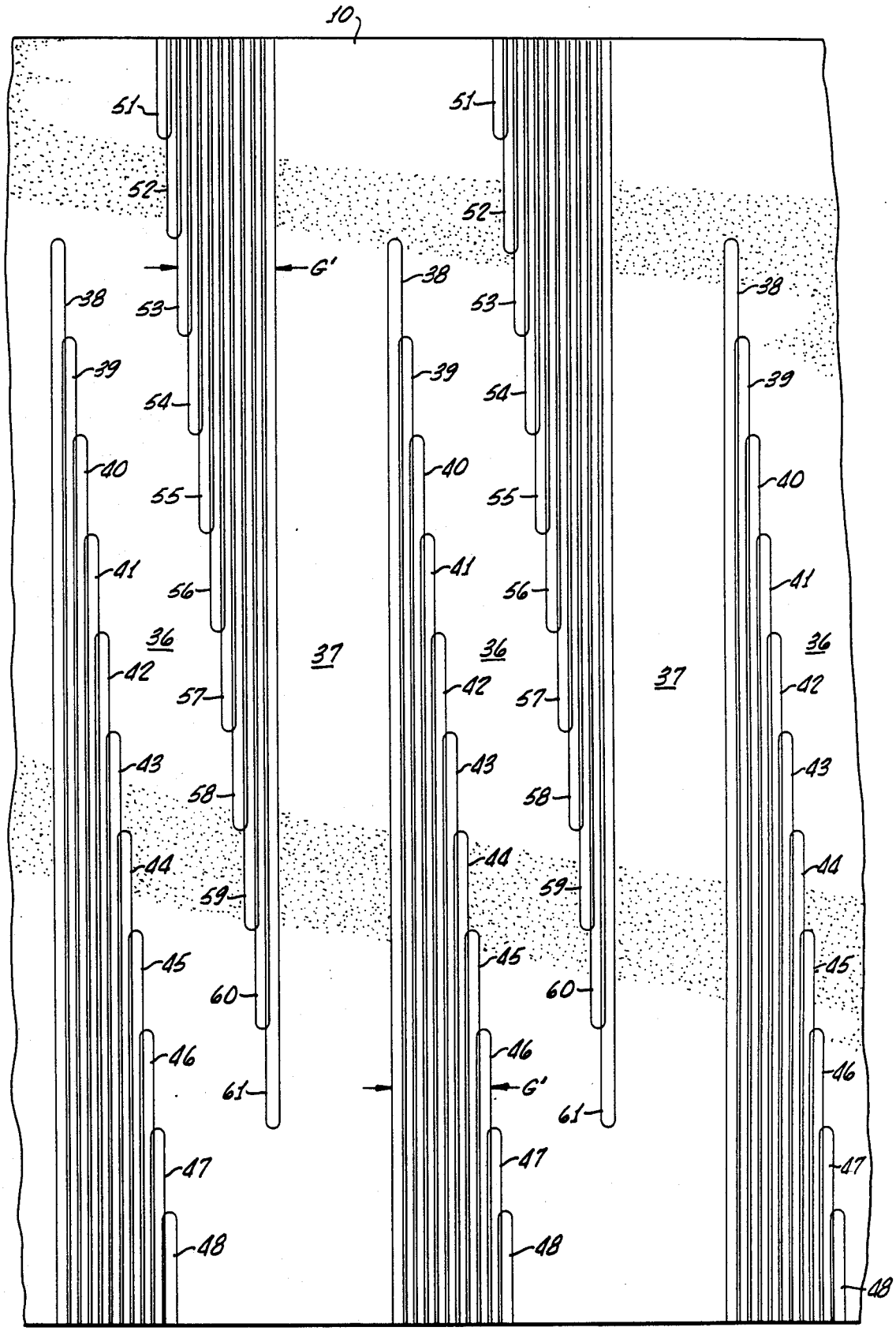
FIG. 3 is a top plan view illustrating a second, and preferred, embodiment of the laser cutting that is employed in the invention.

It is preferred that the width of the resistive film line (line 11, in the illustrated embodiment), at regions other than the apexes, be in a range of from about one-half gap G to about one gap G (that is to say that, at the high end of the range, line width about equals gap width). In FIG. 1, the width of line 11 is (except at the apexes) about 60% of gap G. In the showing of FIG. 3, described below, line width is slightly greater than the width of gap G′ of that figure. For maximum compactness of the substrate, line width is caused to be 50% of gap width.

Referring again to FIG. 1, the adjacent ends of oppositely-directed laser cuts terminate along lines parallel to the axis of the resistor. Thus, as an example, the inner ends of lines 18 and 24 (or 19 and 25, etc.) end at the same imaginary horizontal line. Accordingly, both side edges of the line "step" horizontally at substantially the same points, which means that the entire line (not just its edges) is stepped as shown. The result is that the line has a substantially uniform width.

It is not essential that the altitudes of the pyramids or triangles be perpendicular to the edges of the substrate. (For example, when the substrate is cylindrical all of the laser cuts may be along the same helix, the axis of which is coincident with the axis of the substrate. The substrate is then rotated about its axis, and the laser beam is turned on and off in such programmed manner as to generate the desired substantially triangular or pyramidal regions where the resistive film is totally removed. There is also thus generated a line of exposed substrate that corresponds to gap 13 shown in FIG. 1 of U.S. Pat. No. 3,858,147.)

SPECIFIC EXAMPLE OF LASER CUTTING

Preferably, the laser is a YAG laser apparatus having a focused beam. The diameter of the beam is, for example, 1.5 mils. The machine will shift the beam laterally by a certain increment, after making each of the parallel cuts shown in FIG. 1, not necessarily by any physical movement of any table or support or beam generator, but instead optically. Alternatively, but less desirably in most instances, the lateral beam shifting may be effected by masking, by movement of a table, etc. (Other diameter beams may be employed, for example, one having a diameter of 2 mils.)

Let it be assumed that, in the particular apparatus, each such increment is 0.4 mil. Thus, with the beam diameter of 1.5 mils, the machine is caused to shift three times before the making of each cut. There is, therefore, a 0.3 mil overlap between adjacent cuts, to assure that there will be complete removal of resistive film and thus maximized insurance against any breakdown. Typical overlap regions are shown at 32*a* at upper portions of FIG. 1.

In the showing of FIG. 1, which results in the resistor of FIG. 2, there are nine laser cuts at gap G, and these combine to form a gap of about 10.6 mils. The voltage stress should not exceed 20 volts per mil. Thus, in the stated specific example where the gap G is about 10.6 mils, the voltage stress at the gap G should not exceed about 200 volts. Such a voltage stress is at the lower end of what is desired for the high-voltage resistor, it being pointed out that the gap G is normally larger than 10.6 mils so that more voltage may be applied without exceeding 20 volts per mil.

FURTHER DESCRIPTION, AND DESCRIPTION OF THE PREFERRED EMBODIMENT OF FIG. 3

The present invention provides a highly efficient, compact, stable, noninductive resistor pattern. The resistive film is cut away by successive passes of the laser to form the V-shaped or zigzag resistance path. The laser cuts a 1.5 mil (or other desired width) wide path in the Y direction, that is to say generally perpendicular to the horizontal edge of the illustrated substrate, and there are stop and start points relative to laser operation and which are appropriate to provide a stepped, sloped edge as each cut is indexed in the X direction, that is to say generally horizontally. The invention permits optimum high-voltage capability because the stress between adjacent line portions is graduated, this being contrasted to what would be the case if the laser cuts were parallel and the same length, as would be the case if the pattern were serpentine.

The angle of each line portion, that is to say each zig 11*a* or 11*c*, and each zag 11*b*, is determined by the heights of the laser cuts (lengths thereof). Thus, to produce a resistor that is much wider than the resistor described relative to FIGS. 1 and 2 (or that will be described relative to FIG. 3), it is merely necessary to increase the length of each cut by a desired factor.

To increase the isolation between line portions, more cuts are made and/or the diameter of the laser beam is increased.

To regulate the width of the line, the cuts projecting away from one edge of the resistor are caused to be spaced, horizontally, more or less distance away from the cuts projecting from the other edge thereof. Thus, for example, relative to the showing of FIG. 1, to increase the width of zig 11*a*, there will be more lateral shifting of the beam after completion of cut 22 and before making of cut 23. Each laser cut may be relatively short, or it may have a length at least 50, 100, or even more times the width of the cut (diameter of the laser beam).

Referring next to FIG. 3, there is shown (in a scale which is intermediate that of FIGS. 1 and 2) a resistor in which the triangles are right triangles instead of isosceles. (There may also be forms wherein the triangles are neither isosceles nor right.) Except as specifically stated, the embodiment of FIG. 3 is identical to that of FIGS. 1 and 2.

As previously indicated, the right-triangle embodiment is preferred. Thus, the showing of FIG. 3 is preferred except that—for increased resistor compactness—the width of the line is preferably caused to be about one-half the gap G' shown in FIG. 3 (instead of being slightly larger as shown).

There are, in the preferred embodiment, alternated inclined zigs 36 and vertical zags 37. Zigs 36 (the hypotenuses of the triangles) are uniformly stepped along both edges, while zags 37 (the altitudes of the triangles) have unstepped, straight and parallel edges throughout. An advantage of the FIG. 3 embodiment is that the changes in spacing between zigs and zags are more frequent and linear than in the previous embodiment.

As shown at the left in FIG. 3, there are parallel and somewhat overlapping laser cuts 38–48 of progressively decreasing (from left to right) length. These cuts project from the loer edge of substrate 10. Then, there are laser cuts 51–61 of progressively increasing length, the latter cuts extending downwardly from the upper edge of the substrate. Such cuts 38–48, or 51–61, define right triangles, and are repeated as many times as necessary to form a high-voltage resistor of desired length and voltage capability.

It is emphasized that there are many more steps (for each zig or zag) in FIG. 3 than in FIG. 1, and that there is only one (not two) added widths of laser beam at each step. Thus, the embodiment of FIG. 3 achieves a more linear and voltage-related spacing (between adjacent portions of the zigs and zags) than does that of FIG. 1.

In summary, all embodiments achieve stable, practical, high-precision, compact, high-voltage resistors that are extremely desirable for many applications.

It is pointed out that the resistive coating need not necessarily cover the entire substrate before laser cutting commences. For example, when the resistor is cylindrical, the longitudinal gap may be left unprinted during the silk screening.

The foregoing detailed description is to be clearly understood as given by way of illustration and example only, the spirit and scope of this invention being limited soley by the appended claims.

What is claimed is:

1. A method of making a high-voltage, noninductive, film-type resistor, which comprises:

(a) providing, on an insulating substrate, a coating of resistive material, and (b) employing a laser beam to cut through said coating and cut away, from said coating, portions so shaped that the remaining coating portions form a zigzag line of said resistive material on said substrate, said laser cutting being so effected that each zig of said line converges toward the adjacent zag thereof at an angle sufficiently small that there is a major inductance-cancellation effect between current flowing through each zig and current flowing through the adjacent zag.

2. The method as claimed in claim 1, in which said laser cutting is so effected that there are gnerally right triangles between adjacent zigs and zags of said line.

3. The method as claimed in claim 1, in which said laser cutting is so effected that there are generally isosceles triangles between adjacent zigs and zags of said line.

4. The method as claimed in claim 1, in which said laser cutting is so effected that the width of said line, at regions other than the apexes, is in a range of about one-half to about one times the gap between adjacent apexes.

5. The method as claimed in claim 1, in which said laser cutting is so effected that the width of said line, at regions other than the apexes, is about one-half the gap between adjacent apexes.

6. A method of making a compact, noninductive, high-voltage, film-type resistor, which comprises:

(a) providing, on an insulating substrate, a coating of resistive material, (b) making an elongated laser cut through said coating to thus expose the portion of said substrate beneath said cut, (c) making another laser cut substantially parallel to sid first-mentioned cut and having a length substantially different from that of said first-mentioned cut, thus exposing the portion of said substrate beneath said other cut, and (d) repeating said steps (b) and (c) but with different cut lengths, characterized in that during said repetitions the laser-beam locations and cut lengths are selected to create a zigzag line of said resistive material, and further characterized in that the laser-beam locations and cut lengths are so selected that the regions between each zig of said line and the adjacent zag thereof are substantially triangular.

7. The invention as claimed in claim 6, in which said method is so performed that each of said laser cuts (b) and (c), and repetitions thereof, is parallel to and immediately adjacent a cut of different length, there being no intervening same-length cuts.

8. The invention as claimed in claim 6, in which said laser cuts for each triangular region are first progressively longer and then progressively shorter, and in which said region is substantially an isosceles triangle.

9. The invention as claimed in claim 6, in which said cuts for each triangular region are progressively longer, and in which said region is substantially a right triangle.

10. The product made by the process of claim 1.

11. The product made by the process of claim 6.

* * * * *

UNITED STATES PATENT AND TRADEMARK OFFICE

CERTIFICATE OF CORRECTION

PATENT NO. : 4,670,734

DATED : June 2, 1987

INVENTOR(S) : Richard E. Caddock

It is certified that error appears in the above-identified patent and that said Letters Patent is hereby corrected as shown below:

Claim 2 (column 7, line 18), delete "gnerally" and substitute therefor ---generally---.

Claim 6 (column 8, line 7), delete "sid" and substitute therefor ---said---.

Signed and Sealed this

First Day of September, 1987

*Attest:*

*Attesting Officer*

DONALD J. QUIGG

*Commissioner of Patents and Trademarks*